US008182972B2

(12) United States Patent
Koido

(10) Patent No.: US 8,182,972 B2
(45) Date of Patent: May 22, 2012

(54) DEVELOPER, DEVELOPER STORAGE UNIT, DEVELOPING DEVICE, AND IMAGE FORMING APPARATUS

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 450 days.

(21) Appl. No.: 12/318,325

(22) Filed: Dec. 24, 2008

(65) Prior Publication Data

US 2009/0185836 A1 Jul. 23, 2009

(30) Foreign Application Priority Data

Jan. 21, 2008 (JP) ..... 2008-010372

(51) Int. Cl.
*G03G 9/08* (2006.01)

(52) U.S. Cl. ..... 430/110.1; 430/108.1; 430/110.4

(58) Field of Classification Search ..... 430/108.1, 430/110.1, 110.4
See application file for complete search history.

(56) References Cited

U.S. PATENT DOCUMENTS

| | | | | |
|---|---|---|---|---|
| 6,783,910 | B2 | 8/2004 | Kohtaki et al. | |
| 2003/0129510 | A1* | 7/2003 | Hagi et al. | 430/45 |
| 2003/0180644 | A1 | 9/2003 | Nanya et al. | |
| 2007/0003857 | A1 | 1/2007 | Eida et al. | |

FOREIGN PATENT DOCUMENTS

| | | | |
|---|---|---|---|
| JP | 06-095425 | | 4/1994 |
| JP | 07-248645 | A | 9/1995 |
| JP | 07-261464 | | 10/1995 |
| JP | 07-301943 | | 11/1995 |
| JP | 08-234483 | | 9/1996 |
| JP | 09-114193 | A | 5/1997 |
| JP | 10-207112 | A | 8/1998 |
| JP | 11-102089 | | 4/1999 |
| JP | 2000-047475 | | 2/2000 |
| JP | 2001-075309 | A | 3/2001 |
| JP | 2003-167375 | A | 6/2003 |
| JP | 2004-013049 | A | 1/2004 |
| JP | 2004-054236 | A | 2/2004 |
| JP | 2004-295101 | A | 10/2004 |
| JP | 2005-092194 | | 4/2005 |
| JP | 2006-154093 | | 6/2006 |
| JP | 2006-154157 | A | 6/2006 |
| JP | 2006-221122 | A | 8/2006 |
| JP | 2007-241243 | | 9/2007 |

OTHER PUBLICATIONS

US Office Action for U.S. Appl. No. 11/905,157 mailed on Sep. 30, 2009.

* cited by examiner

*Primary Examiner* — Hoa Le
(74) *Attorney, Agent, or Firm* — Kubotera & Associates, LLC

(57) ABSTRACT

Developer includes toner formed of base particles containing at least a binder resin. The base particles have surfaces coated with an additive agent, and the toner has a volume average particle size between 3.9 μm and 6.1 μm. The developer further includes agglomerates in an amount between 0.01 wt % and 0.10 wt %. The agglomerates have a volume average particle size between 75 μm and 100 μm.

13 Claims, 4 Drawing Sheets

DEVELOPER, DEVELOPER STORAGE UNIT, DEVELOPING DEVICE, AND IMAGE FORMING APPARATUS

BACKGROUND OF THE INVENTION AND RELATED ART STATEMENT

The present invention relates to developer, a developer storage unit, a developing device, and an image forming apparatus.

In a conventional image forming apparatus of an electrophotography type, toner or developer contains toner particles having an average particle size less than 8 μm, hydrophobic silica fine particles having a primary average particle size less than 8 μm, and hydrophobic silica fine particles having a average particle size between 30 μm and 50 μm (refer to Patent Reference).

Patent Reference: Japanese Patent Publication No. 06-095425

In the conventional image forming apparatus described above, when a size of the toner particles decreases, image quality tends to lower.

In view of the problems described above, an object of the present invention is to provide developer including particles having a small size and capable of improving image quality. Another object of the present invention is to provide a developer storage unit, a developing device, an image forming unit, and an image forming apparatus using the developer.

Further objects and advantages of the invention will be apparent from the following description of the invention.

SUMMARY OF THE INVENTION

In order to attain the objects described above, according to the present invention, developer includes toner formed of base particles containing at least a binder resin. The base particles have surfaces coated with an additive agent, and the toner has a volume average particle size between 3.9 μm and 6.1 μm. The developer further includes agglomerates in an amount between 0.01 wt % and 0.10 wt %. The agglomerates have a volume average particle size between 75 μm and 100 μm.

In the present invention, the developer includes the toner having the volume average particle size between 3.9 μm and 6.1 μm. The agglomerates have the volume average particle size between 75 μm and 100 μm. The developer further includes the agglomerates in the amount between 0.01 wt % and 0.10 wt %. Accordingly, it is possible to prevent the developer from deteriorating, thereby improving image quality.

According to the present invention, a developer storage unit retains the developer, thereby improving image quality.

According to the present invention, a developing device includes the developer storage unit; a developer supporting member for supporting the developer retained in the developer storage unit; a developer supply member for supplying the developer to the developer supporting member; and a developer layer forming member for forming a developer layer of the developer supplied with the supply member. With the developing device, it is possible to improve image quality.

According to the present invention, an image forming apparatus includes the developing device. With the image forming apparatus, it is possible to improve image quality.

As described above, the developer includes the toner having the volume average particle size between 3.9 μm and 6.1 μm. The agglomerates have the volume average particle size between 75 μm and 100 μm. The developer further includes the agglomerates in the amount between 0.01 wt % and 0.10 wt %. Accordingly, it is possible to prevent the developer from deteriorating, thereby improving image quality.

DETAILED DESCRIPTION OF THE PREFERRED EMBODIMENTS

Figure 1:
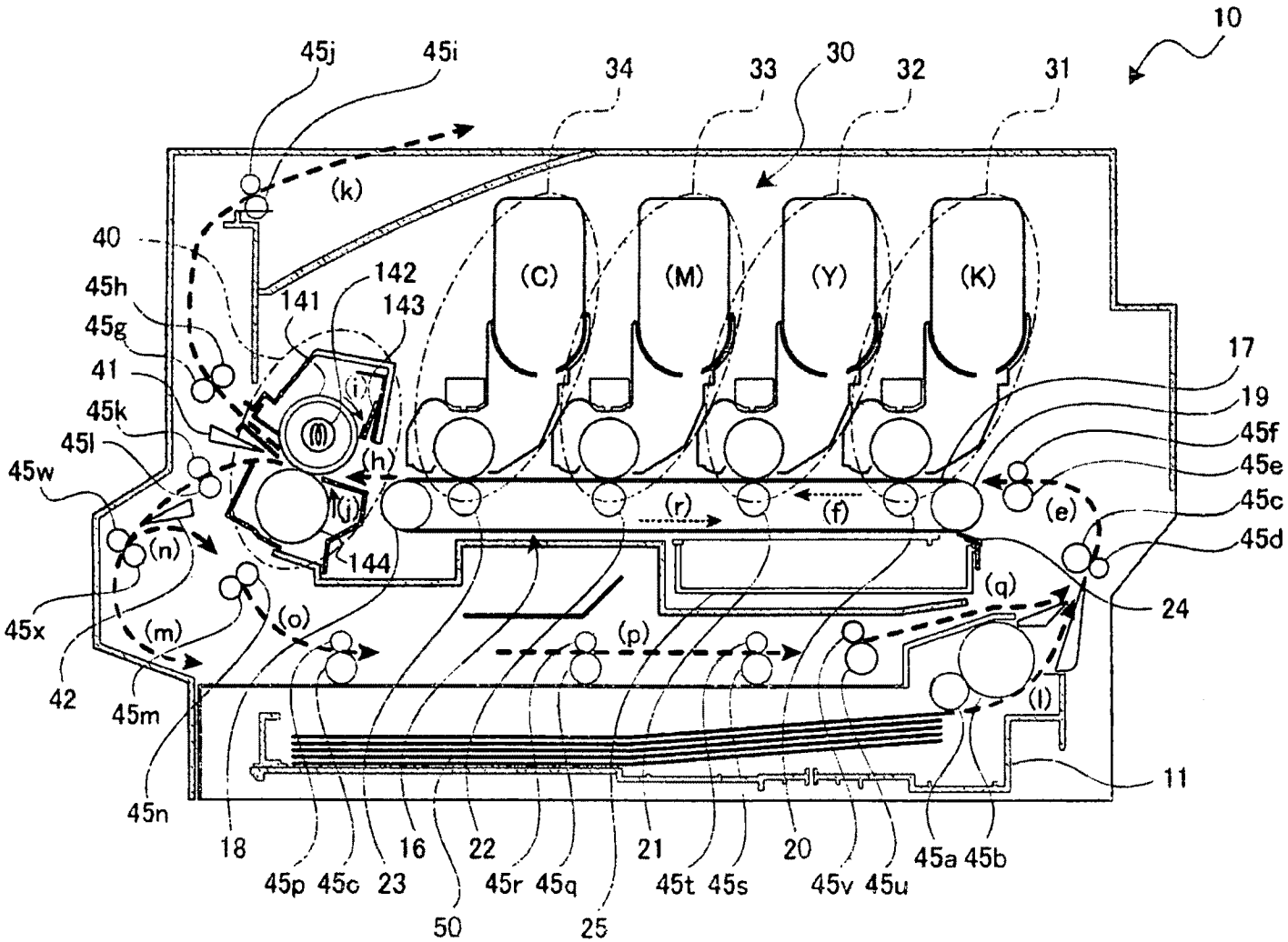
FIG. 1 is a schematic sectional view showing an image forming apparatus according to an embodiment of the present invention.

Hereunder, embodiments of the present invention will be explained with reference to the accompanying drawings. In the drawings, similar components are designated with the same reference numerals.

FIG. 1 is a schematic sectional view showing a printer 10 as an image forming apparatus according to an embodiment of the present invention.

As shown in FIG. 1, the printer 10 is an electro-photography color printer, and includes a recording sheet cassette 11; image forming units 31 to 34; a transfer device 16; a fixing device 40; sheet transport rollers 45*a* to 45*x* for transporting a recording sheet 50; and transport path switching guides 41 and 42.

In the embodiment, the recording sheet cassette 11 retains the recording sheet 50 in a stacked state, and is attached to a lower portion of the printer 10 to be freely detachable. The sheet transport rollers 45*a* and 45*b* pick up the recording sheet 50 retained in the recording sheet cassette 11 one by one, and transport the recording sheet 50 to a sheet transport path in an arrow direction (l) shown in FIG. 1. The sheet transport rollers 45*c* to 45*f* transport the recording sheet 50 and correct a skew of the recording sheet 50 in the sheet transport path in an arrow direction (e) shown in FIG. 1 toward an image forming section 30.

In the embodiment, the image forming section 30 includes the image forming units 31 to 34 arranged along the sheet transport path in a freely detachable state, and the transfer device 16 for transferring developer images formed with the image forming units 31 to 34 to the recording sheet 50 through a coulomb force. The image forming units 31 to 34 have an identical configuration, and use developer in different colors, i.e., black (B), yellow (Y), magenta (M), and cyan (C).

In the embodiment, the transfer device 16 includes a transfer belt 17 for attracting and transporting the recording sheet 50; a drive roller 18 driven with a drive unit (not shown) for driving the transfer belt 17; a tension roller 19 for extending the transfer belt 17 together with the drive roller 18; transfer rollers 20 to 23 disposed to face and abut against photosensitive drums 101 (described later) for transferring a developer image to the recording sheet 50; a transfer belt cleaning blade 24 for cleaning and scraping off developer remaining on the transfer belt 17; and a waste developer tank 25 for collecting developer scraped off with the transfer belt cleaning blade 24.

Figure 2:
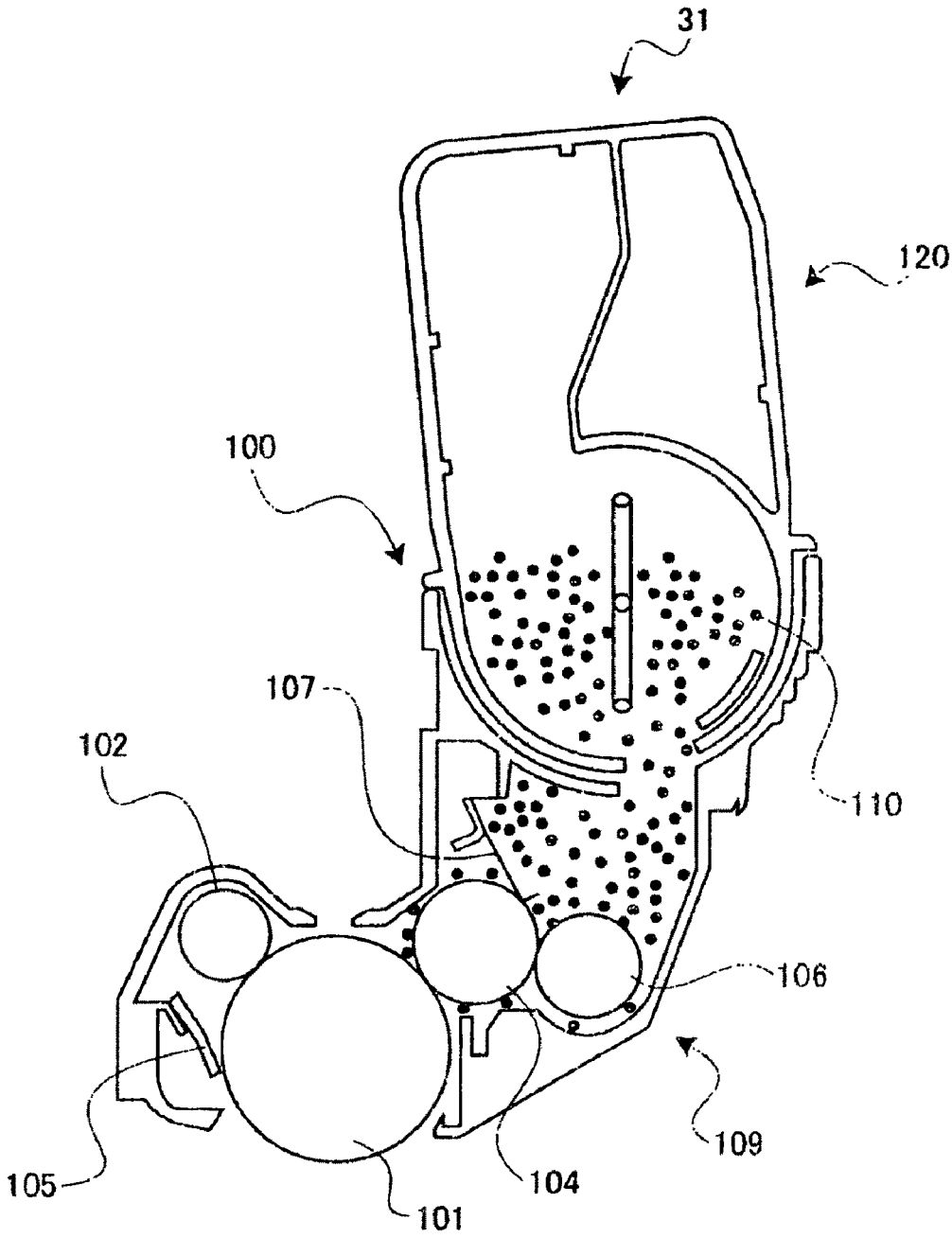
FIG. 2 is a schematic sectional view showing an image forming unit according to the embodiment of the present invention.

A configuration of the image forming unit 31 retaining developer in black (K) will be explained next. As described above, the image forming units 31 to 34 have an identical configuration, and explanations thereof are omitted. FIG. 2 is a schematic sectional view showing the image forming unit 31 according to the embodiment of the present invention.

As shown in FIG. 2, the image forming unit 31 includes a developing device 109; the photosensitive drum 101; a charging roller 102; and a cleaning blade 105. The developing device 109 includes a developing unit 100 and a developer container 102. The developing unit 100 is formed of a developing roller 104, a supply roller 106, and a developing blade 107. The image forming unit 31 is detachably attached to the image forming section 30 at a specific position, and the developer storage unit 120 is detachably attached to the developing unit 100.

Figure 3:
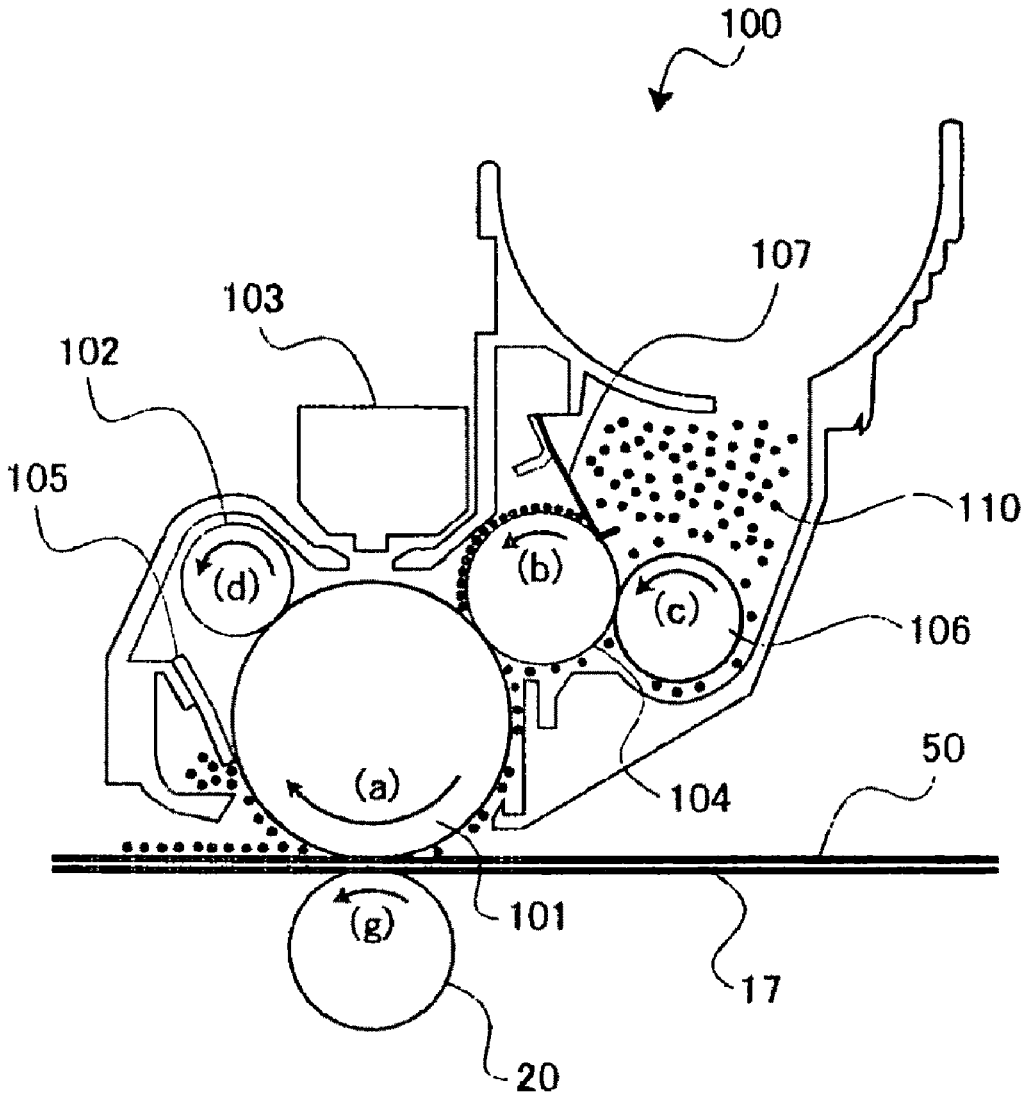
FIG. 3 is a schematic sectional view showing the image forming unit according to the embodiment of the present invention.

FIG. 3 is a schematic sectional view showing the image forming unit 31 according to the embodiment of the present invention. In FIG. 3, the developer storage unit 120 is omitted. The photosensitive drum 101 as an image supporting member is formed of a conductive supporting member and a photo-conductive layer, thereby constituting an organic photosensitive member. The conductive supporting member is a metal pipe formed of aluminum. The photo-conductive layer is formed of a charge generation layer and a charge transport layer sequentially laminated on the metal pipe.

In the embodiment, the charging roller 102 is disposed to contact with a circumference of the photosensitive drum 101 as a charging device, and is formed of a metal shaft and a semi-conductive layer formed of an epichlorohydrin rubber. An LED (Light Emitting Diode) head 103 is disposed above the photosensitive drum 101 as an exposure device. The LED head 103 has a resolution of 600 dpi or 1200 dpi, and is formed of an LED element and a lens array. The LED head 103 is arranged at a position such that light irradiated from the LED element is focused on a surface of the photosensitive drum 101.

In the embodiment, the developing roller 104 is disposed to contact with the circumference of the photosensitive drum 101 as a developer supporting member, and is formed of a metal shaft and a semi-conductive layer formed of a urethane rubber. The supply roller 106 is disposed to contact with the developing roller 104 as a developer supply member, and is formed of a metal shaft and a semi-conductive layer formed of a foamed silicone sponge. The developing blade 107 is disposed to contact with the developing roller 104 as a developer layer forming member, and is formed of stainless steel. The cleaning blade 105 is disposed to contact with the photosensitive drum 101 as a developer collecting member, and is formed of an urethane rubber.

Figure 4:
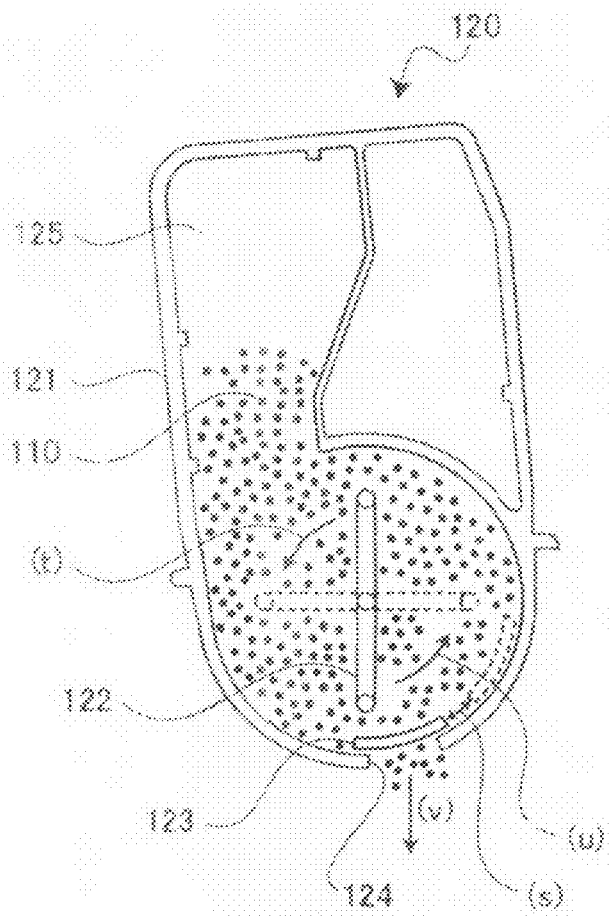
FIG. 4 is a schematic sectional view showing a developer storage unit according to the embodiment of the present invention.

FIG. 4 is a schematic sectional view showing the developer storage unit 120 according to the embodiment of the present invention.

As shown in FIG. 4, the developer storage unit 120 includes a container 121 having a developer storage section 125, and a stirring bar 122 disposed in the developer storage section 125 and extending in a longitudinal direction thereof to be freely rotatable. A discharge outlet 124 is formed in the container 121 below the stirring bar 122 for discharging developer retained in the container 121. A shutter 123 is disposed in the container 121 to be slidable in an arrow direction (s) for opening and closing the discharge outlet 124.

After the developer images in colors are transferred to the recording sheet 50 at the image forming section 30, the recording sheet 50 is transported in the transport path toward the fixing device 40 in an arrow direction (h) (refer to FIG. 1).

As shown in FIG. 3, the fixing device 40 includes a heating roller 141; a pressing roller 144; a thermistor 143; and a heating heater 142. The heating roller 141 is formed of a core shaft with a hollow cylindrical shape formed of aluminum; a heat resistant elastic layer formed of a silicone rubber and disposed on the core shaft; and a PFA (tetrafluoro perfluoroalkylvinylether copolymer) tube disposed on the heat resistant elastic layer. The heating heater 142 such as a halogen lamp is disposed in the core shaft.

In the embodiment, the pressing roller 144 is formed of a core shaft formed of aluminum; a heat resistant elastic layer formed of a silicone rubber and disposed on the core shaft; and a PFA tube disposed on the heat resistant elastic layer. The pressing roller 144 is pressed against the heating roller 141 to form a pressing portion. The thermistor 141 as a surface temperature detection unit is disposed near the heating roller 141 in a non-contact state. The thermistor 141 detects temperature information, and the temperature information is sent to a temperature control unit (not shown). The temperature control unit controls the heating heater 142 to turn on or off according to the temperature information, thereby maintaining a surface temperature of the heating roller 141 at a constant level.

An operation of the printer 10 will be explained next. As shown in FIG. 3, the photosensitive drum 101 is driven with a drive unit (not shown) and rotates in an arrow direction (a) at a constant circumferential seed. The charging roller 102 abuts against the surface of the photosensitive drum 101 to rotate in an arrow direction (d), and applies a direct current voltage supplied from a charge roller high voltage power source (not shown), thereby uniformly charging the surface of the photosensitive drum 101. Then, the LED head 103 facing the photosensitive drum 101 irradiates the surface of the photosensitive drum 101 thus uniformly charged according to an image signal to reduce a potential of an irradiated area, thereby forming a static latent image.

As shown in FIG. 4, after the developer storage unit 120 is attached to the developing unit 100 (refer to FIG. 2), the shutter 123 of the developer storage unit 120 slides in the arrow direction (s) through an operation of a lever (not shown), thereby opening the discharge outlet 124 of the container 121. Accordingly, developer 110 in the container 121 drops in an arrow direction (v) through the discharge outlet 124, thereby supplying to the developing unit 100 (refer to FIG. 2). A supply roller high voltage power source (not shown) applies a voltage to the supply roller 106. After the developer 110 drops into the developing unit 100, the supply roller 106 rotates in an arrow direction (c) to supply the developer 110 to the developing roller 104.

In the embodiment, the developing roller 104 is disposed to contact with the photosensitive drum 101, and a developing roller high voltage power source (not shown) applies a voltage to the developing roller 104. The developing roller 104 attracts the developer 110 supplied from the supply roller 106, and rotates in an arrow direction (d) to transport the developer 110. The developing blade 107 is disposed at a downstream side of the supply roller 106, and contacts with the developing roller 104. When the developing roller 104 transports the developer 110, the developing blade 107 forms a developer layer having a uniform thickness from the developer 110 attracted to the developing roller 104.

In the embodiment, the developing roller 104 reversely develops the static latent image formed on the photosensitive drum 101 with the developer 110 supported thereon. A high voltage power source applies a bias voltage between the conductive supporting member of the developing roller 104 and the developing roller 104, thereby forming an electric flux line associated with the static latent image formed on the photosensitive drum 101 between the developing roller 104 and the photosensitive drum 101. Accordingly, the developer 110 attracted on the developing roller 104 attaches to the static latent image formed on the photosensitive drum 101 through static electricity, thereby developing the area and forming a developer image. When the photosensitive drum 101 starts rotating, the developing process described above starts at a specific timing (described later).

As shown in FIG. 1, the sheet transport rollers 45*a* and 45*b* pick up the recording sheet 50 retained in the recording sheet cassette 11 one by one in the arrow direction (l). Afterward, the sheet transport rollers 45*c* to 45*f* transport the recording sheet 50 along a recording sheet guide (not shown) in an arrow direction (e) while correcting a skew thereof. Then, the drive roller 18 rotates to transport the recording sheet 50 to the transfer belt 17 rotating in an arrow direction (f). The developing process described above starts at a specific timing while the recording sheet 50 is transported in the arrow direction (e).

As shown in FIG. 3, in the developing unit 100 of the image forming unit 31 of black (K), the transfer roller 20 is disposed to face the photosensitive drum 101 with the transfer belt 17 in between. A transfer roller high voltage power source (not shown) applies a voltage to the transfer roller 20, so that the transfer roller 20 performs a transfer process, in which the transfer roller 20 transfers the developer image in black formed on the photosensitive drum 101 through the developing process described above to the recording sheet 50 transported and attracted with the transfer belt 17 through static.

In the next step, as shown in FIG. 1, the transfer belt 17 transports the recording sheet 50 in the arrow direction (f). Similar to the developing process and the transfer process with the image forming unit 31 and the transfer roller 20, the image forming unit 32 and the transfer roller 21 transfer a developer image in yellow to the recording sheet 50. Similarly, the image forming unit 33 and the transfer roller 22 transfer a developer image in magenta to the recording sheet 50, and the image forming unit 34 and the transfer roller 23 transfer a developer image in cyan to the recording sheet 50. After the developer images in colors are transferred to the recording sheet 50, the recording sheet 50 is transported in an arrow direction (h).

In the next step, after the developer images in colors are transferred to the recording sheet 50, and the recording sheet 50 is transported in the arrow direction (h), the recording sheet 50 is transported to the fixing device 40 having the heating roller 141 and the pressing roller 144. A temperature control unit (not shown) maintains a surface temperature of the heating roller 141 at a specific level. The recording sheet 50 moves between the heating roller 141 rotating in an arrow direction (i) and the pressing roller 144 rotating in an arrow direction (j). Accordingly, the heating roller 141 melts the developer images on the recording sheet 50 through heat. Then, the developer images on the recording sheet 50 thus melted are pressed at the pressing portion of the heating roller 141 and the pressing roller 144, thereby fixing the developer images to the recording sheet 50.

After the developer images are fixed to the recording sheet 50, the sheet transport rollers 45*g* to 45*j* transport the recording sheet 50 in an arrow direction (k) shown in FIG. 1, thereby discharging the recording sheet 50 outside the printer 10.

After the developer images are transferred to the recording sheet 50, a small amount of the developer 110 may remain on the surface of the photosensitive drum 101. In this case, the cleaning blade 105 removes the developer 110 thus remaining. The cleaning blade 105 is arranged in parallel to a rotational axis of the photosensitive drum 101. A base portion of the cleaning blade 105 is fixed to a rigid supporting plate, and a distal end portion of the cleaning blade 105 abuts against the surface of the photosensitive drum 101. When the photosensitive drum 101 rotates around the rotational axis while the cleaning blade 105 contacts with the surface of the photosensitive drum 101, the cleaning blade 105 removes the developer 110 remaining on the surface of the photosensitive drum 101. Accordingly, it is possible to repeatedly use the photosensitive drum 101 after cleaning.

In the embodiment, when the printer 10 performs a printing operation continuously, a part of the developer 110 may be transferred to the transfer belt 17 from the photosensitive drum 101 of one of the image forming units 31 to 34. When a part of the developer 110 is transferred to the transfer belt 17, the transfer belt cleaning blade 24 removes the part of the developer 110 from the transfer belt 17 while the transfer belt 17 moves in the arrow direction (f) and an arrow direction (r) shown in FIG. 1, thereby collecting the developer 110 in the waste developer tank 25. Accordingly, it is possible to repeatedly use the transfer belt 17 after cleaning.

When the printer 10 performs a duplex printing operation for printing on both sides of the recording sheet 50, after the sheet transport rollers 45*k*, 45*l*, 45*w*, and 45*x* transport the recording sheet 50 in an arrow direction (m) shown in FIG. 1, the sheet transport rollers 45*w* and 45*x* transport the recording sheet 50 in an arrow direction (n) shown in FIG. 1, thereby reversing the recording sheet 50. Afterward, the sheet transport rollers 45*m* to 45*v* transport the recording sheet 50 in an arrow direction (o), an arrow direction (p), and an arrow direction (q), in this order shown in FIG. 1. When the sheet transport rollers 45*c* and 45*d* transport the recording sheet 50 in the arrow direction (e) shown in FIG. 1, an image is formed on an opposite side of the recording sheet 50 to the side with the developer images fixed thereto.

The developer 110 will be explained in more detail. As described above, the developer 110 is retained in the developer storage unit 120. In the embodiment, each of the image forming apparatus and the developing device includes the developer storage unit 120.

In the embodiment, the developer 110 is formed of toner and agglomerates. The toner is formed of toner base particles containing at least a binder resin. An outer additive such as inorganic fine powders is added to the toner base particles. The binder resin may include a polyester type resin, a styrene-acrylic type resin, an epoxy type resin, and a styrene-butadiene type resin. The binder resin may contain such an additive as a release agent, a colorant, a charging control agent, a conductivity control agent, a body pigment, a reinforcement filler such as a fibril substance, an anti-oxidant, an anti-aging agent, a flow promoter, and a cleaning helper.

In the embodiment, the release agent may include an aliphatic hydrocarbon wax such as a low molecular weight polyethylene, a low molecular weight polypropylene, olefin copolymer, a microcrystalline wax, a paraffin wax, or a Fischer-Tropsch wax; an aliphatic hydrocarbon wax oxide such as a polyethylene wax oxide, or a block copolymer thereof; a wax containing a fatty ester such as a carnauba wax or a montanate wax as a main component; and a wax containing a fatty ester deacidified partially or totally such as a deacidified carnauba wax.

Further, the release agent may include a straight-chain saturated fatty acid such as palmitic acid, stearic acid, montan acid, and a long-chain alkyl carboxylic acid with a long-chain alkyl group; an unsaturated fatty acid such as brassidic acid, eleostearic acid, and barinarin acid; a saturated alcohol such as stearyl alcohol, aralkyl alcohol, behenyl alcohol, carnaubyl alcohol, ceryl alcohol, melissyl alcohol, and a long-chain alkyl alcohol with a long-chain alkyl group; a polyalcohol such as sorbitol; a fatty amide such as linoleic amide, oleic amide, and lauric amide; a saturated fatty bis amide such as methylene bis stearamide, ethylene bis capramide, ethylene bis lauramide, and hexamethylene bis stearamide; an unsaturated fatty amide such as ethylene bis oleamide, hexamethylene bis oleamide, N,N'-dioleyl adipamide, and N,N'-dioleyl sebacamide; an aromatic bis amide such as m-xylene bis stearamide and N,N'-distearyl isophthalamide; a graft wax having an aliphatic hydrocarbon wax with a vinyl monomer such as styrene and acrylate grafted thereto; a partially esterified compound of a fatty acid and a polyalcohol such as behenic monoglyceride; and a methyl ester compound with a hydroxyl groups obtained by hydrogenation of vegetable oil.

In the embodiment, 0.1 to 15 weight parts, more preferably 0.5 to 12 weight parts, of the release agent is added to 100 weight parts of the binder resin. A plurality of types of waxes is preferably used.

In the embodiment, the colorant may include a dye, a pigment, or the like used as a colorant for toner. The colorant may include carbon black, phthalocyanine blue, permanent brown FG, brilliant fast scarlet, pigment green B, rhodamine-B base, solvent red 49, solvent red 146, (Pigment Blue 15:3), solvent blue 35, quinacridone, carmine 6B, disazoyellow, and the likes.

In the embodiment, 2 to 35 weight parts of the colorant is preferably added to 100 weight parts of the binder resin. The charging control agent may include a salicylic acid complex.

In the embodiment, the outer additive is added for improving environmental stability, charging stability, developing ability, flow ability, and a shelf life. The outer additive may include inorganic fine powders such as silica fine powders. As described above, the outer additive is added to the toner base particles to form the toner.

In the embodiment, the toner has a volume average particle size between 3.9 μm and 6.1 μm. When the toner has the volume average particle size of 6.1 μm, it is possible to reduce uneven density, i.e., unevenness of an image density, in a dot of the developer image formed on the recording sheet 50 with the LED head 103 having a resolution of 600 dpi. When the toner has the volume average particle size of 3.9 μm or 5.0 μm, it is possible to reduce uneven density in a dot of the developer image formed on the recording sheet 50 with the LED head 103 having a resolution of 1,200 dpi. Further, when the dot is observed with a 200-power magnifying glass, it is confirmed that a dot without developer or a variance in a diameter of dots does not occur, that it, dot forming abnormality does not occur. Accordingly, when the toner has the volume average particle size between 3.9 μm and 6.1 μm, it is possible to form an image with a high resolution. When the toner has a too small volume average particle size, low image quality such as the fog and the uneven density occurs.

In the embodiment, the volume average particle size is determined from a volume distribution measured with, for example, Coulter Multisizer 3 (a product of Beckman Coulter K. K.). Then, a measurement device determines the volume average particle size. The measurement device is connected to an interface and a personal computer for outputting a number distribution and a volume distribution.

More specifically, 1.0 to 1.5 ml of an interfacial active agent such as alkyl benzene sulfonic acid as a dispersion agent is added to 100 to 150 ml of an electrolytic aqueous solution such as 1% NaCl aqueous solution prepared with first grade sodium chloride or ISOTON T-II (a product of Coulter Scientific Japan). Then, 2 to 20 mg of a specimen is dispersed in the solution to obtain an electrolytic solution sample. The sample is dispersed with an ultrasonic dispersion device for about one minute, and an aperture having a diameter of 100 μm is used to determine a volume distribution, so that the volume average particle size is determined from the volume distribution.

In the embodiment, the agglomerates are formed in an agglomerated form of an outer additive. The agglomerates are screened with a screen, so that the agglomerates are divided according to a size of the screen. The agglomerates in general are not completely bound each other. Accordingly, when a particle distribution of the agglomerates is measured with Coulter Multisizer 3, the agglomerates are dispersed in a solution and separated into fine powders. The agglomerates preferably have the volume average particle size between 75 μm and 100 μm. The developer includes the agglomerates in an amount between 0.01 wt % and 0.10 wt %.

In the embodiment, wt % represents a weight percentage of a specific subject relative to an entire portion, and is defined as follows.

$$\text{Weight percentage}=(\text{mass of subject}/\text{total mass})\times 100$$

In the embodiment, the specific subject is the agglomerates having the volume average particle size between 75 μm and 100 μm, and the total mass represents a mass of the entire developer, that is, a mass of the base particles of the toner, the outer additive, and the agglomerates.

As described above, the agglomerates are formed in the agglomerated form of the outer additive, and are screened with a screen having a size between 75 μm and 100 μm. Then, the agglomerates are added to the toner not containing particles having a size between 75 μm and 100 μm. When the agglomerates are not crashed or not sufficiently crashed, the agglomerates may contain particles of an outer additive having a size between 75 μm and 100 μm. In this case, the agglomerates are added to the toner as the toner base particles. It is suffice that the developer includes the agglomerates having a size between 75 μm and 100 μm in an amount between 0.01 wt % and 0.10 wt %.

First Embodiment

A first embodiment of the present invention will be explained next. In the first embodiment, an experiment was conducted using the developer containing the toner with various volume average particle sizes and the agglomerates with various amounts. In the experiment, the printer 10 shown in FIG. 1 as the image forming apparatus performed a continuous printing operation. In the experiment, the image forming units 31 to 33 were detached from the printer 10, and only the image forming unit 34 was used. It is confirmed that when all the image forming units 31 to 34 are attached to the printer 10, it is possible to obtain a same effect.

In the experiment, the printer 10 performed the continuous printing operation at a speed of 274 mm/s, that is, a sheet transportation speed of the printer 10 and a linear speed of the photosensitive drum 101. Further, the developing roller 104 rotated at a speed ratio of 1.26 relative to the photosensitive drum 101 in an opposite direction, and the supply roller 106 rotated at a speed ratio of 1/1.6 relative to the developing roller 104 in the same direction. The photosensitive drum 101 had an outer diameter of 30 mm, the developing roller 104 had an outer diameter of 15.95 mm, and the supply roller 106 had an outer diameter of 13 mm.

In the experiment, A4 size standard sheets (for example, OKI excellent white paper with a weight of 80 g $m^2$) were placed in the printer 10 such that a backside of the sheet upon opening a package became a printing surface. The A4 size standard sheet was transported through the transport path of the printer 10 such that short sides thereof became a trailing edge and a front edge thereof (in a longitudinal direction thereof). It was configured that a sheet was transported such that a trailing edge thereof was apart from a leading edge of a subsequent sheet by 60 mm when 30,000 sheets were continuously printed.

In the experiment, a lateral line print pattern having a size of 0.86 mm×200 mm was printed on the A4 size standard sheet at a duty of 0.3%. When a solid printing is performed on an entire printable area (288 mm×200 mm) of the A4 size standard sheet, the duty is defined as 100%. When 30,000 of the A4 size standard sheets were continuously printed, the photosensitive drum 101 rotated for 113,642.4 rotations except a test printing. During the continuous printing operation, a half-tone image was printed on 10 of the A4 size standard sheets per every 5,000 sheets from the beginning of the continuous printing operation for evaluating unevenness of the image and quality of dots thus formed.

In the experiment, at the beginning and the end of the continuous printing operation, the A4 size standard sheets (for example, OKI excellent white paper with a weight of 80 g/m$^2$) were placed in the printer 10 such that a backside of the sheet upon opening a package became a printing surface, and 10 sheets are printed at the duty of 0.3%. Accordingly, when one test was completed without any trouble, the photosensitive drum 101 rotated for 114,028.2 rotations.

In the experiment, the half-tone image was evaluated for reproduction ability in terms of print quality of a printed portion. In order to evaluate print quality of a non-printed portion, a gloss sheet was used without printing an image, thereby preventing the developer from attaching the gloss sheet.

As opposed to an ordinary sheet, the gloss sheet has a smooth surface. Accordingly, the developer is easy to crash and spread during the fixing process, thereby making it easy to evaluate. For example, a gloss meter GM-26D (a product of MURAKAMI COLOR RESEARCH LABORATORY, 75°) was used to measure gloss of the A4 size standard sheet and an A4 size standard gloss sheet. A result showed that the gloss of the A4 size standard sheet was 11.7%, and the gloss of the A4 size standard gloss sheet was 60.7%, thereby indicating that the A4 size standard gloss sheet has a smoother surface and higher gloss than those of the A4 size standard sheet.

In the experiment, after the half-tone image was printed on 10 of the A4 size standard sheets per every 5,000 sheets, the printed sample was evaluated in terms of fog, uneven density, and dot abnormality. The fog occurs in a non-printed area where developer with a low charge amount or developer charged with an opposite polarity relative to developer charged normally is attached. Smear occurs in a non-printed area where developer with a high charge amount or developer excessively charged relative to developer charged normally is attached.

In the experiment, in order to evaluate the fog, a color difference meter CM-2600d (a product of Konica Minolta Holdings Inc., C light source, 2 degree view angle) was used to measure a color difference (ΔE) in hue (L*a*b) of the non-printed portion of the A4 size standard gloss sheet with and without the image forming unit. More specifically, before and after the continuous printing operation, the A4 size standard gloss sheet was printed, and hue (L*a*b) of the non-printed portion was measured. Then, the A4 size standard gloss sheet was printed without the image forming unit while the fixing device was operated under a condition the same as that of the continuous printing operation, and hue (L*a*b) of the non-printed portion was measured, thereby determining the color difference (ΔE).

In the experiment, the color difference (ΔE) was determined as an average of 10 sheets. When the color difference (ΔE) was less than 1.5 both before and after the continuous printing operation, the result was good. When the color difference (ΔE) was greater than 1.5 at least before or after the continuous printing operation, the result was poor.

In the experiment, in order to evaluate the uneven density and the dot abnormality, the half-tone image was printed on the sheets at a resolution of 600 dpi through the continuous printing operation. The half-tone image was printed on the entire printable area of the A4 size standard sheet, and included a dot of one box formed of one dot×one dot, i.e., one dot in a lateral direction and one dot in a vertical direction, among four boxes having a two-dot lateral size and a two-dot vertical size.

In order to evaluate the uneven density, a density at a most dense portion was compared with a density at a least dense portion, and a density difference was determined. When the density difference was more than 30%, it was confirmed to be the uneven density.

In order to evaluate the dot abnormality, the dot was enlarged by 200 times, and fifty of the dots were randomly observed. When the dot was missing or a smear was found between the dots, it was confirmed to be the dot abnormality.

Table 1 shows the result of the experiment using the developer including the toner having various volume average particle sizes, and the agglomerates having various amounts.

TABLE 1

| | Base Particle (Weight Parts) | R972 (Weight Parts) | RY50 (Weight Parts) | RY50 Agglomerate (Weight Parts) | Volume average particle size (μm) | Agglomerate amount (wt %) |
|---|---|---|---|---|---|---|
| Sample 1-1 | 100 | 2.5 | 2.0 | 0.0501 | 5.0 | 0.050 |
| Comparative Sample 1-1 | 100 | 2.5 | 2.0 | 0.0000 | 5.0 | 0.000 |
| Comparative Sample 1-2 | 100 | 2.5 | 2.0 | 0.0000 | 7.8 | 0.000 |
| Comparative Sample 1-3 | 100 | 2.5 | 2.0 | 0.0501 | 7.8 | 0.050 |
| Sample 1-2 | 100 | 2.5 | 2.0 | 0.0101 | 5.0 | 0.010 |
| Sample 1-3 | 100 | 2.5 | 2.0 | 0.1010 | 5.0 | 0.100 |
| Comparative Sample 1-4 | 100 | 2.5 | 2.0 | 0.1610 | 5.0 | 0.160 |
| Sample 1-4 | 100 | 2.5 | 2.0 | 0.0501 | 3.9 | 0.050 |
| Sample 1-5 | 100 | 2.5 | 2.0 | 0.0501 | 6.1 | 0.050 |
| Comparative Sample 1-5 | 100 | 2.5 | 2.0 | 0.0501 | 3.5 | 0.050 |

TABLE 1-continued

| | | | | | | |
|---|---|---|---|---|---|---|
| Comparative Sample 1-6 | 100 | 2.5 | 2.0 | 0.0101 | 5.0 | 0.000 |
| Sample 1-6 | 100 | 2.5 | 2.0 | 0.0501 | 5.0 | 0.050 |
| Sample 1-7 | 100 | 2.5 | 2.0 | 0.0501 | 5.0 | 0.050 |
| Sample 1-8 | 100 | 2.5 | 2.0 | 0.0101 | 3.9 | 0.010 |
| Sample 1-9 | 100 | 2.5 | 2.0 | 0.0101 | 6.1 | 0.010 |
| Sample 1-10 | 100 | 2.5 | 2.0 | 0.1010 | 3.9 | 0.100 |
| Sample 1-11 | 100 | 2.5 | 2.0 | 0.1010 | 6.1 | 0.100 |
| Comparative Sample 1-7 | 100 | 2.5 | 2.0 | 0.0101 | 5.0 | 0.000 |
| Comparative Sample 1-8 | 100 | 2.5 | 2.0 | 0.1010 | 5.0 | 0.000 |
| Comparative Sample 1-9 | 100 | 2.5 | 2.0 | 0.2010 | 5.0 | 0.000 |
| Comparative Sample 1-10 | 100 | 2.5 | 2.0 | 0.1310 | 5.0 | 0.130 |

| | Print quality | | | | |
|---|---|---|---|---|---|
| | Glass sheet fog | | | Half-tone image | |
| | Before | After | Fog | Uneven darkness | Dot abnormality |
| Sample 1-1 | 0.5 | 1.0 | Good | No | No |
| Comparative Sample 1-1 | 0.6 | 2.1 | Poor | Yes | Yes |
| Comparative Sample 1-2 | 0.9 | 2.0 | Poor | Yes | Yes |
| Comparative Sample 1-3 | 0.9 | 1.3 | Good | No | Yes |
| Sample 1-2 | 0.6 | 1.3 | Good | No | No |
| Sample 1-3 | 0.2 | 0.8 | Good | No | No |
| Comparative Sample 1-4 | 0.2 | 0.6 | Good | No | Yes |
| Sample 1-4 | 0.7 | 1.1 | Good | No | No |
| Sample 1-5 | 0.7 | 1.0 | Good | No | No |
| Comparative Sample 1-5 | 1.2 | 1.9 | Poor | Yes | Yes |
| Comparative Sample 1-6 | 0.8 | 1.2 | Good | No | Yes |
| Sample 1-6 | 0.6 | 1.2 | Good | No | No |
| Sample 1-7 | 0.5 | 0.9 | Good | No | No |
| Sample 1-8 | 0.8 | 1.4 | Good | No | No |
| Sample 1-9 | 0.8 | 1.3 | Good | No | No |
| Sample 1-10 | 0.4 | 1.0 | Good | No | No |
| Sample 1-11 | 0.5 | 0.9 | Good | No | No |
| Comparative Sample 1-7 | 0.8 | 2.1 | Poor | Yes | Yes |
| Comparative Sample 1-8 | 0.6 | 1.9 | Poor | Yes | Yes |
| Comparative Sample 1-9 | 0.4 | 1.8 | Poor | Yes | Yes |
| Comparative Sample 1-10 | 0.2 | 0.7 | Good | No | Yes |

In the experiment, in producing the developer of the sample 1-1, 100 weight parts of a binder resin (polyester resin with a number average molecular weight of 3700 and a glass transition temperature of 62° C.); 0.2 weight parts of a charge control agent formed of salicylic acid complex (Bontoron E-84, a product of Orient Chemical Industries Inc.); 4.0 weight parts of a pigment blue 15:3 (ECB-301, a product of Dainichiseika Color & Chemicals Mfg. Co., Ltd.); and 5.0 weight parts of release agent formed of carnauba wax (carnauba wax No. 1 powder, a product of S. Kato & Co.) were mixed in a Henschel mixer (a product of Mitsui Mining Co., Ltd.). The mixture was melted and kneaded with a twin-screw kneading machine. After cooling, the mixture was roughly crashed with a cutter mill having a screen with a diameter of 2 mm. Then, the mixture was further crashed with a crashing pulverizer (Dispersion separator, a produce of Nippon Pneumatic Manufacturing Co., Ltd.), and was classified with a blow classifier to obtain the base particles.

In the next step, 2.5 weight parts of hydrophobic silica R972 (a product of NIPPON AEROSIL Co., Ltd., a first order average diameter of 16 μm) and 2.0 weight parts of hydrophobic silica RY50 (a product of NIPPON AEROSIL Co., Ltd., a first order average diameter of 40 μm) were mixed with 100 weight parts of the base particles. The hydrophobic silica was added as the outer additive separated from inorganic agglomerated powders with a Henschel mixer and the likes. Afterward, the mixture was stirred in a Henschel mixer with 10-liter capacity for two minutes at 3200 rotations per minute.

In the last step, the mixture was screened with a screen having an opening size of 75 μm (made of stainless steel, a wire diameter of 50 μm, a plain fabric, 200 openings/inch, comply with JIS-Z8801-1994). The mixture was screened for 30 seconds after no dropping particles were confirmed with a power detector MULTI TESTER MT-1001 (a product of Seishin Enterprise Co., Ltd.) at a vibration amplitude of 1.5 mm and a frequency of 50 Hz, thereby obtaining the toner.

In the next step, 1.0 gram of hydrophobic silica RY50 was retained in a cylinder with a diameter of 30 mm, and a weight was placed on hydrophobic silica RY50 for five minutes at a pressure of 500 g/cm$^2$ to agglomerate hydrophobic silica RY50. Then, hydrophobic silica RY50 was separated with a Henschel mixer, and was screened with a screen having an opening size of 100 μm (made of stainless steel, a wire diameter of 70 μm, a plain fabric, 150 openings/inch, comply with ISO, usable under JIS). Hydrophobic silica RY50 was screened for 30 seconds after no dropping particles were confirmed with the power detector described above at a vibration amplitude of 1.5 mm and a frequency of 50 Hz.

In the next step, hydrophobic silica RY50 was screened with a screen having an opening size of 75 μm for 30 seconds after no dropping particles were confirmed with the power detector at a vibration amplitude of 1.5 mm and a frequency of 50 Hz, thereby obtaining an agglomerated silica. Then, 0.0501 weight parts of the agglomerated silica was added to 100 weight parts of the toner, and the mixture was stirred in a Henschel mixer with 10-liter capacity for two minutes at 3200 rotations per minute, thereby obtaining the developer.

The developer thus obtained had a volume average particle diameter of 5.0 μm measured with a cell counting analyzer (Coulter Multisizer, a product of Beckman Coulter K. K.) under an aperture diameter of 100 μm at 30,000 count. No particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

As shown in Table 1, in the developer of the sample 1-1, the color difference (ΔE) indicating the fog was smaller than 1.5 before and after the continuous printing operation, thereby showing a good result. When the color difference (ΔE) is smaller than 1.5, an unprinted portion of a printed sheet is not visibly noticeable, and poses no practical problem. When the color difference (ΔE) is smaller than 1.0, an unprinted portion of a printed sheet is completely unnoticeable. Further, the uneven density and the dot abnormality were not found in the half-tone image.

In the experiment, the developer of the comparative sample 1-1 contained the toner prepared through the same process as that of the sample 1-1, and did not contain the agglomerated silica. The developer thus obtained had a volume average particle diameter of 5.0 μm, and did not contain agglomerates having a size between 75 μm and 100 μm. Accordingly, when the developer was agglomerated in the developing device, the developer thus agglomerated was not separated with agglomerates. As a result, the developer was charged unevenly, thereby creating the fog after the continuous printing operation. Further, the uneven density and the dot abnormality were found in the half-tone image.

In the experiment, the developer of the comparative sample 1-2 was obtained through an adjusted process, in which the base particles of the toner were crashed and separated under a condition the same as that of the sample 1-1, and the base particles were screened with a screen having an opening with a size of 75 μm. Similar to comparative sample 1-1, the developer of the comparative sample 1-2 did not contain the agglomerated silica.

The toner of the developer thus obtained had a volume average particle diameter of 7.8 μm, and no particles larger than 20 μm were found in the volume distribution obtained at the same time with the cell counting analyzer. The developer of the comparative sample 1-2 had the large volume average particle diameter, and did not contain the agglomerated silica having a size between 75 μm and 100 μm. Accordingly, when the continuous printing operation was performed using the developer, the developer was charged unevenly, thereby creating the fog after the continuous printing operation. Further, the uneven density and the dot abnormality were found in the half-tone image.

In the experiment, the toner of the comparative sample 1-3 was obtained through an adjusted process, in which the base particles of the toner were crashed and separated under a condition the same as that of the sample 1-1, and the base particles were screened with a screen having an opening with a size of 75 μm. Then, 0.0501 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 7.8 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %. When the continuous printing operation was performed using the developer of the comparative sample 1-3, the dot abnormality was found in the half-tone image due to the large volume average particle diameter of the toner.

In the experiment, the toner of the sample 1-2 was obtained under a condition the same as that of the sample 1-1. Then, 0.0101 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.5 mg, i.e., a remaining agglomerate of the developer was 0.010 wt %.

When the continuous printing operation was performed using the developer of the sample 1-2, the color difference (ΔE) indicating the fog was smaller than 1.5 before and after the continuous printing operation, thereby showing a good result. Further, the uneven density and the dot abnormality were not found in the half-tone image.

In the experiment, the toner of the sample 1-3 was obtained under a condition the same as that of the sample 1-1. Then, 0.0101 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 5.0 mg, i.e., a remaining agglomerate of the developer was 0.100 wt %.

When the continuous printing operation was performed using the developer of the sample 1-3, the color difference (ΔE) indicating the fog was smaller than 1.0 before and after the continuous printing operation, thereby showing a good result. Further, the uneven density and the dot abnormality were not found in the half-tone image.

In the experiment, the toner of the comparative sample 1-4 was obtained through an adjusted process, in which the base particles of the toner were crashed and separated under a condition the same as that of the sample 1-1, and the base particles were screened with a screen having an opening with a size of 75 μm. Then, 0.1610 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 8.0 mg, i.e., a remaining agglomerate of the developer was 0.160 wt %. When the continuous printing operation was performed using the developer of the comparative sample 1-4, the dot abnormality was found in the half-tone image due to the large amount of the agglomerated silica having a size between 75 μm and 100 μm.

In the experiment, the toner of the sample 1-4 was obtained under a condition the same as that of the sample 1-1. Then, 0.0501 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 3.9 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

When the continuous printing operation was performed using the developer of the sample 1-4, the color difference (ΔE) indicating the fog was smaller than 1.5 before and after the continuous printing operation, thereby showing a good result. Further, the uneven density and the dot abnormality were not found in the half-tone image.

In the experiment, the toner of the sample 1-5 was obtained under a condition the same as that of the sample 1-1. Then, 0.0501 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 6.1 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

When the continuous printing operation was performed using the developer of the sample 1-5, the color difference (ΔE) indicating the fog was smaller than 1.0 before and after the continuous printing operation, thereby showing a good result. Further, the uneven density and the dot abnormality were not found in the half-tone image.

In the experiment, the toner of the comparative sample 1-5 was obtained through an adjusted process, in which the base particles of the toner were crashed and separated under a condition the same as that of the sample 1-1, and the base particles was screen with a screen having an opening with a size of 75 μm. Then, 0.0501 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 3.5 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The toner of the developer of the comparative sample 1-5 had the small volume average particle size, so that the developer had a large surface area (a specific surface area) relative to a volume thereof. Accordingly, the developer easily adhered to the photosensitive drum. When the continuous printing operation was performed using the developer of the comparative sample 1-5, the developer was attached to an area where no static latent image was formed, in addition to an area where a static latent image was formed, thereby creating the fog. Further, the developer was charged unevenly, thereby creating the uneven density and the dot abnormality in the half-tone image.

In the experiment, the toner of the comparative sample 1-6 was obtained through an adjusted process, in which the base particles of the toner were crashed and separated under a condition the same as that of the sample 1-1, and the base particles was screen with a screen having an opening with a size of 125 μm (made of stainless steel, a wire diameter of 90 μm, a plain fabric, 120 openings/inch, a diameter of 75 mm). Then, 0.0101 weight parts of hydrophobic silica RY50, i.e., the agglomerates not passing through an opening of 100 μm, was added to 100 weight parts of the toner, thereby preparing the developer.

The toner of the developer thus prepared had a volume average particle diameter of 50.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.0 mg, i.e., a remaining agglomerate of the developer was 0.000 wt %. Further, after 5.0 gram of the developer was screened with a screen having an opening size of 100 μm, an amount of the agglomerated silica remaining on the screen was 0.5 mg, i.e., a remaining agglomerate of the developer was 0.0100 wt %.

The toner of the developer of the comparative sample 1-6 included the agglomerates having a size larger than 100 μm. Accordingly, an area without the developer was formed on the developing roller as a streak in a circumferential direction thereof, thereby forming an image with a white streak. That is, the dot abnormality occurred in the half-tone image.

In the experiment, the toner of the sample 1-6 was obtained under a condition the same as that of the sample 1-1. Then, 0.0501 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

When the continuous printing operation was performed using the developer of the sample 1-6, the color difference (ΔE) indicating the fog was smaller than 1.5 before and after the continuous printing operation, thereby showing a good result. Further, the uneven density and the dot abnormality were not found in the half-tone image.

In the experiment, the toner of the sample 1-7 was obtained under a condition the same as that of the sample 1-1. Then, 0.050 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

When the continuous printing operation was performed using the developer of the sample 1-7, the color difference (ΔE) indicating the fog was smaller than 1.0 before and after the continuous printing operation, thereby showing a good result. Further, the uneven density and the dot abnormality were not found in the half-tone image.

In the experiment, the toner of the sample 1-8 was obtained under a condition the same as that of the sample 1-1. Then, 0.0101 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 3.9 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.5 mg, i.e., a remaining agglomerate of the developer was 0.010 wt %.

When the continuous printing operation was performed using the developer of the sample 1-8, the color difference (ΔE) indicating the fog was smaller than 1.5 before and after the continuous printing operation, thereby showing a good result. Further, the uneven density and the dot abnormality were not found in the half-tone image.

In the experiment, the toner of the sample 1-9 was obtained under a condition the same as that of the sample 1-1. Then, 0.0101 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 6.1 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.5 mg, i.e., a remaining agglomerate of the developer was 0.010 wt %.

When the continuous printing operation was performed using the developer of the sample 1-9, the color difference (ΔE) indicating the fog was smaller than 1.5 before and after the continuous printing operation, thereby showing a good result. Further, the uneven density and the dot abnormality were not found in the half-tone image.

In the experiment, the toner of the sample 1-10 was obtained under a condition the same as that of the sample 1-1. Then, 0.1010 weight parts of hydrophobic silica RY50, i.e., the agglomerates having a size between 75 μm and 100 μm was added to 100 weight parts of the toner, thereby preparing the developer.

The toner of the developer thus prepared had a volume average particle diameter of 3.9 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 5.0 mg, i.e., a remaining agglomerate of the developer was 0.100 wt %.

When the continuous printing operation was performed using the developer of the sample 1-10, the color difference (ΔE) indicating the fog was smaller than 1.0 before and after the continuous printing operation, thereby showing a good result. Further, the uneven density and the dot abnormality were not found in the half-tone image.

In the experiment, the toner of the sample 1-11 was obtained under a condition the same as that of the sample 1-1. Then, 0.1010 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 6.1 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 5.0 mg, i.e., a remaining agglomerate of the developer was 0.100 wt %.

When the continuous printing operation was performed using the developer of the sample 1-11, the color difference (ΔE) indicating the fog was smaller than 1.0 before and after the continuous printing operation, thereby showing a good result. Further, the uneven density and the dot abnormality were not found in the half-tone image.

In the experiment, the developer of the comparative sample 1-7 contained the toner prepared through the same process as that of the sample 1-1. Then, 0.0101 weight parts of hydrophobic silica RY50, i.e., the agglomerates passing through a mesh having an opening of 75 μm, was added to 100 weight parts of the toner, thereby preparing the developer. The developer thus obtained had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.0 mg, i.e., a remaining agglomerate of the developer was 0.000 wt %.

The developer of the comparative sample 1-7 did not contain a large amount of the agglomerates having a size between 75 μm and 100 μm. Accordingly, when the developer was agglomerated in the developing device, the developer thus agglomerated was not separated with agglomerates. As a result, when the continuously printing operation was performed using the developer of the comparative sample 1-8, the developer was charged unevenly, thereby creating the fog after the continuous printing operation. Further, the uneven density and the dot abnormality were found in the half-tone image.

In the experiment, the developer of the comparative sample 1-8 contained the toner prepared through the same process as that of the sample 1-1. Then, 0.1010 weight parts of hydrophobic silica RY50, i.e., the agglomerates passing through a mesh having an opening of 75 μm, was added to 100 weight parts of the toner, thereby preparing the developer. The developer thus obtained had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.0 mg, i.e., a remaining agglomerate of the developer was 0.000 wt %.

The developer of the comparative sample 1-8 did not contain a large amount of the agglomerates having a size between 75 μm and 100 μm. Accordingly, when the developer was agglomerated in the developing device, the developer thus agglomerated was not separated with agglomerates. As a result, when the continuously printing operation was performed using the developer of the comparative sample 1-8, the developer was charged unevenly, thereby creating the fog after the continuous printing operation. Further, the uneven density and the dot abnormality were found in the half-tone image.

In the experiment, the developer of the comparative sample 1-9 contained the toner prepared through the same process as that of the sample 1-1. Then, 0.2010 weight parts of hydrophobic silica RY50, i.e., the agglomerates passing through a mesh having an opening of 75 μm, was added to 100 weight parts of the toner, thereby preparing the developer. The developer thus obtained had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 0.0 mg, i.e., a remaining agglomerate of the developer was 0.000 wt %.

The developer of the comparative sample 1-9 did not contain a large amount of the agglomerates having a size between 75 μm and 100 μm. Accordingly, when the developer was agglomerated in the developing device, the developer thus agglomerated was not separated with agglomerates. As a result, when the continuously printing operation was performed using the developer of the comparative sample 1-8, the developer was charged unevenly, thereby creating the fog after the continuous printing operation. Further, the uneven density and the dot abnormality were found in the half-tone image.

In the comparative samples 1-7 to 1-9, the agglomerates having a size less than 75 μm were added. Note that the uneven density and the dot abnormality were found in the half-tone image regardless of amount of the agglomerates. Further, the fog was created after the continuous printing operation. Accordingly, regardless of an amount of the agglomerates having a size less than 75 μm, when the agglomerates having a size larger than 75 μm were added, it was possible to reduce the uneven density and the dot abnormality, and prevent the fog from being created.

In the experiment, the toner of the comparative sample 1-10 was obtained under a condition the same as that of the sample 1-1. Then, 0.1308 weight parts of hydrophobic silica RY50, i.e., the agglomerates having a size between 75 μm and 100 μm, was added to 100 weight parts of the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 6.5 mg, i.e., a remaining agglomerate of the developer was 0.130 wt %.

The developer of the comparative sample 1-10 included a large amount of the agglomerates having a size between 75 μm and 100 μm. Accordingly, when the continuously printing operation was performed using the developer of the comparative sample 1-10, the dot abnormality was found in the half-tone image.

According to the result of the experiment described above, it is preferred that the toner of the developer has a volume average particle diameter between 3.9 μm and 6.1 μm. When the toner of the developer has a volume average particle diameter less than 3.9 μm, the particles have a too small diameter and a specific surface area of the developer increases. Accordingly, the developer tends to stick to an unprinted area, and the fog tends to occur. When the toner of the developer has a volume average particle diameter larger than 6.1 μm, the particles have a too large diameter. Accordingly, a static latent image tends to have the dot abnormality such as deteriorated dot reproduction, dot without developer, dots with various sizes, and the likes.

More preferably, the toner of the developer has a volume average particle diameter between 3.9 μm and 5.0 μm. When the volume average particle diameter is within the range, it is possible to form an image with high resolution using an LED head with 600 dpi or an LED head with 1,200 dpi for forming the image without the uneven density, dot without developer, dots with various sizes, and the likes.

According to the result of the experiment described above, it is preferred that the agglomerates of the developer have a size between 75 μm and 100 μm. When the agglomerates have a size less than 75 μm, it is difficult for the agglomerate to separate the agglomerated developer. Accordingly, the developer was charged unevenly, thereby creating the uneven density and the dot abnormality in the half-tone image. When the developer does not contain the agglomerates, the same problems occur. When the agglomerates have a size larger than 100 μm, the developing blade is caught with the agglomerates, thereby causing an area without the developer layer due to the agglomerates, and causing a white streak in an image thus formed.

According to the result of the experiment described above, it is preferred that the developer contains the agglomerates having a size between 75 μm and 100 μm in a range between 0.01 wt % and 0.10 wt %. When the developer contains the agglomerates less than 0.01 wt %, it is difficult to sufficiently separate the toner, thereby causing the developer unevenly charged, and creating the uneven density and the dot abnormality.

Even though the fog is not generated at the beginning of the printing operation, when the printing operation is performed continuously performed, the developer tends to be agglomerated and it is difficult to separate the developer thus agglomerated with the agglomerates.

When the developer contains the agglomerates greater than 0.10 wt %, the developer contains too many the agglomerates, and the agglomerates occupy a large area in the developer image. Accordingly, the developer image tends to have an area without the developer. As a result, a static latent image tends to have the dot abnormality such as deteriorated dot reproduction, dot without developer, dots with various sizes, and the likes.

As described above, when the toner of the developer has a volume average particle diameter between 3.9 μm and 6.1 μm, the agglomerates of the developer have a size between 75 μm and 100 μm, and the developer contains the agglomerates in a range between 0.01 wt % and 0.10 wt %, the agglomerates in the developer form proper spaces between components of the developing device and the base particles of the toner, or between the base particles of the toner. Accordingly, the base particles of the toner tend to contact with each other to a less extent, thereby preventing the developer from deteriorating. Further, it is possible to stably charge the developer, thereby obtaining a half-tone image without prominent fog.

Second Embodiment

A second embodiment of the present invention will be explained. In the first embodiment, an experiment was conducted using the developer having various degree of agglomeration thereof. In the experiment, similar to the first embodiment, the image forming units 31 to 33 were detached from the printer 10, and only the image forming unit 34 shown in FIG. 1 was used.

In the experiment, the printer 10 performed the continuous printing operation at a speed of 274 mm/s. The A4 size standard sheet was transported through the transport path of the printer 10 in the longitudinal direction thereof. During the continuous printing operation, a solid image of a 100% duty was printed on 100 of the A4 size standard sheets, and print densities of first, 50th, and 100th sheets were measured.

In the experiment, the toner of the developer had a volume average particle diameter between 3.9 μm and 6.1 μm, the agglomerates of the developer had a size between 75 μm and 150 μm, and the developer contained the agglomerates in a range between 0.01 wt % and 0.10 wt %.

In the embodiment, the print density was measured with X-Rite 528 (a product of X-Rite Corp., D-50 light source, status I). Nine measurement points were defined on the sheet at one quarter, half, and three quarter in a vertical direction, and one quarter, half, and three quarter in a lateral direction. The print density was defined as an average of the nine measurement points.

When the solid image printed on at least one of the first, 50th, and 100th sheets showed the print density grater than 1.30, and a difference (density difference) between a largest print density and a smallest print density among the first, 50th, and 100th sheets was less than 0.10, the result was good. When all the solid images printed on the first, 50th, and 100th sheets showed the print density grater than 1.35, and the density difference was less than 0.05, the result was good. Otherwise, the result was poor.

In the embodiment, the degree of the agglomeration was measured through the following method. First, 2.0 gram of the developer was placed on a screen having an opening size of 250 μm (made of stainless steel, a wire diameter of 160 μm, a plain fabric, 60 openings/inch, a diameter of 75 mm, comply with JIS-Z8801-1994). A screen having an opening size of 150 μm (made of stainless steel, a wire diameter of 100 μm, a plain fabric, 100 openings/inch, a diameter of 75 mm, comply with JIS-Z8801-1994) was placed below the screen described above. Then, a screen having an opening size of 75 μm (made of stainless steel, a wire diameter of 50 μm, a plain fabric, 200 openings/inch, a diameter of 75 mm, comply with JIS-Z8801-1-94) was placed below the screen described above.

In the next step, the three screens were set to MULTI TESTER MT-1001 (a product of Seishin Enterprise Co., Ltd.), and were vibrated for 90 seconds at a vibration amplitude of 1.5 mm and a frequency of 50 Hz. Afterward, amounts of the developer remaining on the screen having an opening size of 250 μm, the screen having an opening size of 150 μm, and the screen having an opening size of 75 μm were measured, respectively.

The degree of the agglomeration (%) was defined as:

$$100\times(a+0.6\times b+0.2\times c)/d$$

where a is the amount (g) of the developer remaining on the screen having an opening size of 250 μm, a is the amount (g) of the developer remaining on the screen having an opening size of 150 μm, a is the amount (g) of the developer remaining on the screen having an opening size of 75 μm, and d is the amount (g) of the developer placed on the screen having an opening size of 250 μm before the vibration. When the degree of the agglomeration is small, friction between the particles of the developer is small, thereby easily making it easy to flow. When the degree of the agglomeration is large, friction between the particles of the developer is large, thereby making it difficult to flow.

Table 2 shows the result of the experiment using the developer having various degrees of the agglomeration.

TABLE 2

| | Silica | | | Density | | | | |
|---|---|---|---|---|---|---|---|---|
| | Type | Amount | Agglomeration (%) | 1 | 50 | 100 | Difference | Result |
| Sample 2-1 | R972 | 2.0 | 40.3 | 1.35 | 1.39 | 1.40 | 0.05 | Excellent |
| Sample 2-2 | R972 | 1.6 | 59.5 | 1.39 | 1.41 | 1.42 | 0.03 | Excellent |

TABLE 2-continued

| | Silica | | | Density | | | | |
|---|---|---|---|---|---|---|---|---|
| | Type | Amount | Agglomeration (%) | 1 | 50 | 100 | Difference | Result |
| Sample 2-3 | R972 | 1.3 | 69.1 | 1.43 | 1.43 | 1.35 | 0.08 | Good |
| Comparative Sample 2-1 | R972 | 1.0 | 75.5 | 1.43 | 1.35 | 1.21 | 0.22 | Poor |
| Comparative Sample 2-2 | R972 | 2.5 | 32.0 | 1.25 | 1.30 | 1.34 | 0.09 | Poor |
| Sample 2-4 | RX300 | 0.6 | 55.1 | 1.37 | 1.40 | 1.41 | 0.04 | Excellent |
| Sample 2-5 | RX300 | 0.4 | 60.9 | 1.42 | 1.42 | 1.38 | 0.04 | Excellent |
| Comparative Sample 2-3 | RX300 | 0.2 | 73.2 | 1.43 | 1.36 | 1.22 | 0.21 | Poor |
| Comparative Sample 2-4 | RX300 | 1.2 | 38.4 | 1.29 | 1.33 | 1.36 | 0.07 | Poor |
| Sample 2-6 | R972 | 2.0 | 41.0 | 1.36 | 1.40 | 1.41 | 0.05 | Excellent |
| Comparative Sample 2-5 | R972 | 2.5 | 30.3 | 1.24 | 1.30 | 1.32 | 0.08 | Poor |
| Comparative Sample 2-6 | R972 | 2.5 | 25.0 | 1.21 | 1.28 | 1.29 | 0.08 | Poor |
| Comparative Sample 2-7 | R972 | 2.5 | 20.9 | 1.19 | 1.26 | 1.29 | 0.10 | Poor |
| Comparative Sample 2-8 | R972 | 2.5 | 37.4 | 1.28 | 1.38 | 1.40 | 0.12 | Poor |
| Sample 2-7 | R972 | 2.5 | 43.5 | 1.35 | 1.39 | 1.40 | 0.05 | Excellent |
| Sample 2-8 | R972 | 2.5 | 50.1 | 1.37 | 1.41 | 1.41 | 0.04 | Excellent |
| Comparative Sample 2-9 | R972 | 2.5 | 26.6 | 1.23 | 1.29 | 1.32 | 0.09 | Poor |
| Comparative Sample 2-10 | R972 | 2.5 | 39.8 | 1.29 | 1.37 | 1.39 | 0.10 | Poor |
| Comparative Sample 2-11 | R972 | 2.5 | 31.8 | 1.25 | 1.36 | 1.37 | 0.12 | Poor |
| Comparative Sample 2-12 | R972 | 2.5 | 34.9 | 1.26 | 1.38 | 1.39 | 0.13 | Poor |

In the sample 2-1 of the experiment, 2.0 weight parts of hydrophobic silica R972 was added as the outer additive to 100 weight parts of the base particles of the toner, and then the toner was obtained under a condition the same as that of the sample 1-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-1 had the degree of the agglomeration of 40.3%. When the solid images were printed on 100 sheets using the developer, all the solid images printed on the first, 50th, and 100th sheets showed the print density grater than 1.35, and the density difference was less than 0.05, thereby obtaining the high density, the low density difference, and good gradation reproducibility.

In the sample 2-2 of the experiment, 1.6 weight parts of hydrophobic silica R972 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-2 had the degree of the agglomeration of 59.5%. When the solid images were printed on 100 sheets using the developer, all the solid images printed on the first, 50th, and 100th sheets showed the print density grater than 1.35, and the density difference was less than 0.05, thereby obtaining the high density, the low density difference, and good gradation reproducibility.

In the sample 2-3 of the experiment, 1.3 weight parts of hydrophobic silica R972 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-3 had the degree of the agglomeration of 69.1%. When the solid images were printed on 100 sheets using the developer, all the solid images printed on the first, 50th, and 100th sheets showed the print density grater than 1.35, and the density difference was less than 0.05, thereby obtaining the high density, the low density difference, and good gradation reproducibility.

In the comparative sample 2-1 of the experiment, 1.0 weight parts of hydrophobic silica R972 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the comparative sample 2-1 had the degree of the agglomeration of 75.5%. When the solid images were printed on 100 sheets using the developer, the solid images printed on the first and 50th sheets showed the print density grater than 1.35. However, the solid image printed on the 100th sheet showed the print density less than 1.30. Accordingly, the density difference was greater than 0.10, thereby showing the fluctuated and unstable density.

The developer of the comparative sample 2-2 was identical to the developer of the sample 1-1. The developer of the comparative sample 2-2 had the degree of the agglomeration of 32.0%. When the solid images were printed on 100 sheets using the developer, the solid image printed on the first sheet showed the print density less than 1.30, thereby showing the low initial density.

In the sample 2-4 of the experiment, instead of hydrophobic silica R972, 0.6 weight parts of hydrophobic silica RX300 (a product of NIPPON AEROSIL Co., Ltd., a first order average diameter of 7 μm) was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-4 had the degree of the agglomeration of 55.1%. When the solid images were printed on 100 sheets using the developer, all the solid images printed on the first, 50th, and 100th sheets showed the print density grater than 1.35, and the density difference was less than 0.05, thereby obtaining the high density, the low density difference, and good gradation reproducibility.

In the sample 2-5 of the experiment, instead of hydrophobic silica R972, 0.4 weight parts of hydrophobic silica RX300 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-5 had the degree of the agglomeration of 60.9%. When the solid images were printed on 100 sheets using the developer, all the solid images printed on the first, 50th, and 100th sheets showed the print density grater than 1.35, and the density difference was less than 0.05, thereby obtaining the high density, the low density difference, and good gradation reproducibility.

In the comparative sample 2-3 of the experiment, instead of hydrophobic silica R972, 0.2 weight parts of hydrophobic silica RX300 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the comparative sample 2-3 had the degree of the agglomeration of 73.2%. When the solid images were printed on 100 sheets using the developer, the solid images printed on the first and 50th sheets showed the print density grater than 1.35. However, the solid image printed on the 100th sheet showed the print density less than 1.30. Accordingly, the density difference was grater than 0.10, thereby showing the fluctuated and unstable density.

In the comparative sample 2-4 of the experiment, instead of hydrophobic silica R972, 1.2 weight parts of hydrophobic silica RX300 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the comparative sample 2-4 had the degree of the agglomeration of 38.4%. When the solid images were printed on 100 sheets using the developer, the solid image printed on the first sheet showed the print density less than 1.30, thereby showing the low initial density.

In the sample 2-3 of the experiment, instead of 1.6 weight parts in the sample 2-2, 2.0 weight parts of hydrophobic silica R972 was added as the outer additive to 100 weight parts of the base particles of the toner, and then the toner was obtained under a condition the same as that of the sample 2-1. Then, hydrophobic silica RY50, i.e., the agglomerates having a size between 75 μm and 100 μm, was added to the toner, thereby preparing the developer.

The toner of the developer thus prepared had a volume average particle diameter of 5.0 μm, and no particles larger than 20 μm were found in the volume distribution obtained at the same time with the cell counting analyzer. After 5.0 gram of the developer was screened with a screen having an opening size of 100 μm, the developer passing the screen was further screened with a screen having an opening size of 75 μm. An amount of the agglomerated silica remaining on the screen was 2.5 mg, i.e., a remaining agglomerate of the developer was 0.050 wt %.

The developer of the sample 2-6 had the degree of the agglomeration of 41.0%. When the solid images were printed on 100 sheets using the developer, all the solid images printed on the first, 50th, and 100th sheets showed the print density grater than 1.35, and the density difference was less than 0.05, thereby showing the stable density difference and good print quality.

The developer of the comparative sample 2-5 was identical to the developer of the comparative sample 1-1. The developer of the comparative sample 2-5 had the degree of the agglomeration of 30.3%. When the solid images were printed on 100 sheets using the developer, the solid image printed on the first sheet showed the print density less than 1.30, thereby showing the low initial density.

The developer of the comparative sample 2-6 was identical to the developer of the comparative sample 1-2. The developer of the comparative sample 2-6 had the degree of the agglomeration of 25.0%. When the solid images were printed on 100 sheets using the developer, all the solid images printed on the first, 50th, and 100th sheets showed the print density less than 1.30, thereby showing the low density.

The developer of the comparative sample 2-7 was identical to the developer of the comparative sample 1-3. The developer of the comparative sample 2-7 had the degree of the agglomeration of 20.9%. When the solid images were printed on 100 sheets using the developer, the solid image printed on the first sheet showed the print density less than 1.30, thereby showing the low initial density.

The developer of the comparative sample 2-8 was identical to the developer of the sample 1-2. The developer of the comparative sample 2-8 had the degree of the agglomeration of 37.4%. When the solid images were printed on 100 sheets using the developer, the solid image printed on the first sheet showed the print density less than 1.30, and the density difference was greater than 0.10, thereby showing the low initial density and the fluctuated and unstable density.

The developer of the sample 2-7 was identical to the developer of the sample 1-3. The developer of the sample 2-7 had the degree of the agglomeration of 43.5%. When the solid images were printed on 100 sheets using the developer, all the solid images printed on the first, 50th, and 100th sheets showed the print density greater than 1.35, and the density difference was less than 0.05, thereby obtaining the high density and the low density difference.

The developer of the sample 2-8 was identical to the developer of the sample 1-4. The developer of the sample 2-8 had the degree of the agglomeration of 50.1%. When the solid images were printed on 100 sheets using the developer, all the solid images printed on the first, 50th, and 100th sheets showed the print density greater than 1.35, and the density difference was less than 0.05, thereby obtaining the high density and the low density difference.

The developer of the comparative sample 2-9 was identical to the developer of the sample 1-5. The developer of the comparative sample 2-8 had the degree of the agglomeration of 26.2%. When the solid images were printed on 100 sheets using the developer, the solid images printed on the first and 50th sheets showed the print density less than 1.30, thereby showing the low density.

The developer of the comparative sample 2-10 was identical to the developer of the comparative sample 1-5. The developer of the comparative sample 2-10 had the degree of the agglomeration of 39.8%. When the solid images were printed on 100 sheets using the developer, the solid image printed on the first sheet showed the print density less than 1.30, thereby showing the low initial density.

The developer of the comparative sample 2-11 was identical to the developer of the sample 1-6. The developer of the comparative sample 2-11 had the degree of the agglomeration of 31.8%. When the solid images were printed on 100 sheets using the developer, the solid image printed on the first sheet showed the print density less than 1.30, and the density difference was greater than 0.10, thereby showing the low initial density and the fluctuated and unstable density.

The developer of the comparative sample 2-12 was identical to the developer of the sample 1-7. The developer of the comparative sample 2-12 had the degree of the agglomeration of 34.9%. When the solid images were printed on 100 sheets using the developer, the solid image printed on the first sheet showed the print density less than 1.30, and the density difference was greater than 0.10, thereby showing the low initial density and the fluctuated and unstable density.

According to the result of the experiment, when the developer has the degree of the agglomeration between 40.3% and 60.9%, the developer is stably supplied. Accordingly, it is possible to stably form a solid image from the beginning of the printing operation. More specifically, among the toner of the developer having a volume average particle diameter between 3.9 μm and 6.1 μm, in which the agglomerates of the developer have a size between 75 μm and 150 μm, and the developer contains the agglomerates in a range between 0.01 wt % and 0.10 wt %, when the developer has the degree of the agglomeration between 40.3% and 60.9%, it is possible to prevent the density from fluctuating, and to stably form a solid image from the beginning of the continuous printing operation.

Third Embodiment

A third embodiment of the present invention will be explained next. In the third embodiment, an experiment was conducted for evaluating an afterimage. In the experiment, the developing blade 107 abutting against the developing roller 104 had various curvatures (R) and various thicknesses, thereby changing an amount of the developer per unit area in the developer layer formed on the developing roller 104.

In the experiment, the developer of the sample 2-2 was used. Similar to the first and second embodiments, the image forming units 31 to 33 were detached from the printer 10, and only the image forming unit 34 shown in FIG. 1 was used.

In the experiment, the amount of the developer in the developer layer formed on the developing roller 104 was measured as follows. First a metal block formed of stainless steel having a surface with an area of 1 $cm^2$ was prepared. A double-sided tape (a product of Too Corporation) with an area of 1 $cm^2$ was attached to the surface with an area of 1 $cm^2$. An opposite side of the double-sided tape remained attachable to the developer, and was attached to the developer layer formed on the developing roller 104.

In the next step, the metal shaft of the developing roller 104 was grounded, and an external direct current power source applied a voltage of 300 V to the developer layer formed on the developing roller 104 through the metal block, so that the developer layer was attached to the metal block. The amount of the developer per unit area (1 $cm^2$) was determined from a difference in the total weight of the metal block before and after the developer layer was attached to the metal block.

Figure 5:
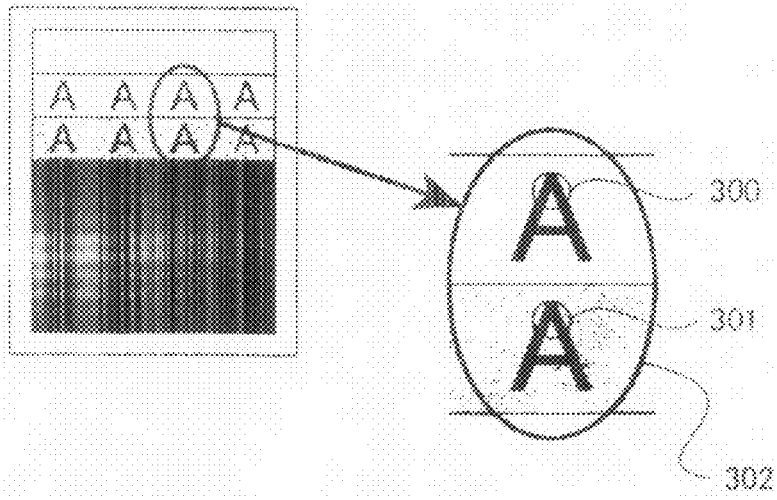
FIG. 5 is a schematic view showing a method of evaluating an afterimage according to the embodiment of the present invention.

In the experiment, the afterimage was evaluated as follows. FIG. 5 is a schematic view showing the method of evaluating the afterimage according to the embodiment of the present invention. First, the A4 size standard sheet was transported in the longitudinal direction thereof, and the printer 10 performed the printing operation at a speed of 274 mm/s to form images of a character "A" at a top portion of the A4 size standard sheet and a solid image below the images as shown in FIG. 5.

In the next step, densities of the images thus formed were measured at three measurement locations 301, 302, and 303 with X-Rite 528 (a product of X-Rite Corp., D-50 light source, status I). Among the densities at the measurement locations 301, 302, and 303, a difference between the largest density and the smallest density was determined as an indicator of the afterimage.

When all the densities at the measurement locations 301, 302, and 303 were greater than 1.30, and the difference was less than 0.06, the afterimage became less visible. Accordingly, the result was good. When all the densities at the measurement locations 301, 302, and 303 were greater than 1.35, and the difference was less than 0.03, the afterimage became unnoticeable. Accordingly, the result was excellent. Otherwise, the result was poor.

Table 3 shows the result of the experiment.

TABLE 3

| | Developing blade | | Developer layer | Density | | | | |
|---|---|---|---|---|---|---|---|---|
| | | | | Measurement location | | | | |
| | Curvature R (mm) | Thickness (mm) | thickness ($mg/cm^2$) | 300 | 301 | 302 | Difference | Result |
| Sample 3-1 | 0.19 | 0.08 | 0.30 | 1.35 | 1.38 | 1.36 | 0.03 | Excellent |
| Sample 3-2 | 0.22 | 0.08 | 0.43 | 1.39 | 1.39 | 1.39 | 0.00 | Excellent |
| Sample 3-3 | 0.28 | 0.08 | 0.58 | 1.43 | 1.42 | 1.38 | 0.05 | Good |
| Comparative Sample 3-1 | 0.31 | 0.08 | 0.65 | 1.46 | 1.35 | 1.42 | 0.11 | Poor |
| Comparative Sample 3-2 | 0.17 | 0.08 | 0.25 | 1.29 | 1.30 | 1.21 | 0.08 | Poor |
| Sample 3-4 | 0.31 | 0.10 | 0.52 | 1.41 | 1.40 | 1.39 | 0.02 | Excellent |
| Comparative Sample 3-3 | 0.22 | 0.08 | 0.42 | 1.32 | 1.32 | 1.20 | 0.12 | Poor |

In the sample 3-1, the developing blade 107 of the image forming unit 34 was formed of a plate made of SUS304 having a distal end portion with a curvature R of 0.19 mm and a thickness of 0.08 mm. The amount of the developer in the developer layer was measured with the method described above at the printing speed of 274 mm/s, and was determined to be 0.30 $mg/cm^2$. Then, the images as described above were formed to evaluate the afterimage. All the densities at the measurement locations 301, 302, and 303 were greater than 1.35, and the difference was less than 0.03, thereby showing the excellent result.

In the sample 3-2, the developing blade 107 of the image forming unit 34 was formed of a plate made of SUS304 having a distal end portion with a curvature R of 0.22 mm and a thickness of 0.08 mm. Similar to the sample 3-1, the amount of the developer in the developer layer was measured, and was determined to be 0.43 $mg/cm^2$. Then, the images as described above were formed to evaluate the afterimage. All the densities at the measurement locations 301, 302, and 303 were greater than 1.35, and the difference was less than 0.00, thereby showing the excellent result.

In the sample 3-3, the developing blade 107 of the image forming unit 34 was formed of a plate made of SUS304 having a distal end portion with a curvature R of 0.28 mm and a thickness of 0.08 mm. Similar to the sample 3-1, the amount of the developer in the developer layer was measured, and was determined to be 0.58 $mg/cm^2$. Then, the images as described above were formed to evaluate the afterimage. All the densities at the measurement locations 301, 302, and 303 were greater than 1.35, and the difference was less than 0.05, thereby showing the good result.

In the comparative sample 3-1, the developing blade 107 of the image forming unit 34 was formed of a plate made of SUS304 having a distal end portion with a curvature R of 0.31 mm and a thickness of 0.08 mm. Similar to the sample 3-1, the amount of the developer in the developer layer was measured, and was determined to be 0.65 $mg/cm^2$. Then, the images as described above were formed to evaluate the afterimage. All the densities at the measurement locations 301, 302, and 303 were greater than 1.35. However, the difference was 0.11, thereby creating a negative afterimage due to an insufficient amount of the developer.

In the comparative sample 3-2, the developing blade 107 of the image forming unit 34 was formed of a plate made of SUS304 having a distal end portion with a curvature R of 0.17 mm and a thickness of 0.08 mm. Similar to the sample 3-1, the amount of the developer in the developer layer was measured, and was determined to be 0.25 $mg/cm^2$. Then, the images as described above were formed to evaluate the afterimage. Some of the densities at the measurement locations 301, 302, and 303 were less than 1.30. Further, the difference was 0.08, thereby creating a positive afterimage due to an insufficient initial charge of the developer, and causing the insufficient density.

In the sample 3-4, the developing blade 107 of the image forming unit 34 was formed of a plate made of SUS304 having a distal end portion with a curvature R of 0.31 mm and a thickness of 0.10 mm. Similar to the sample 3-1, the amount of the developer in the developer layer was measured, and was determined to be 0.52 mg/cm$^2$. Then, the images as described above were formed to evaluate the afterimage. All the densities at the measurement locations 301, 302, and 303 were greater than 1.35, and the difference was less than 0.02, thereby showing the excellent result.

In the comparative sample 3-3, the developer prepared without the agglomerates in the sample 2-2 was used. Then, the developing blade 107 of the image forming unit 34 was formed of a plate made of SUS304 having a distal end portion with a curvature R of 0.22 mm and a thickness of 0.08 mm. Similar to the sample 3-1, the amount of the developer in the developer layer was measured, and was determined to be 0.42 mg/cm$^2$. Then, the images as described above were formed to evaluate the afterimage. Some of the densities at the measurement locations 301, 302, and 303 were less than 1.30. Further, the difference was 0.12, thereby creating a positive afterimage due to an insufficient initial charge of the developer, and causing the insufficient density.

In the embodiments described above, the photosensitive drum 101 includes an inorganic photosensitive drum formed of, for example, a photosensitive layer of a material such as selenium and amorphous silicon disposed on a conductive roller of aluminum and the likes, or an organic photosensitive drum formed of, for example, an organic photosensitive layer of a binder resin containing a charge generating agent and a charge transport agent disposed on a conductive roller of aluminum and the likes.

In the embodiments described above, the developing roller 104 includes, in addition to the configuration described above, a general developing roller of stainless steel having a conductive base shaft coated with a silicone rubber or a urethane rubber containing carbon black for adjusting electric resistivity thereof. Further, the developing roller 104 may be a developing blade formed of a metal or a rubber material such as a silicon rubber. A voltage may be applied to the developing roller 104.

The disclosure of Japanese Patent Application No. 2008-010372, filed on Jan. 21, 2008, is incorporated in the application by the reference.

While the invention has been explained with reference to the specific embodiments of the invention, the explanation is illustrative and the invention is limited only by the appended claims.

What is claimed is:

1. Developer comprising:

toner formed of base particles each containing at least a binder resin, said base particles each having a surface coated with an additive agent, said toner having a volume average particle size between 3.9 μm and 6.1 μm inclusive; and agglomerates having respective particle sizes between 75 μm and 100 μm inclusive, said agglomerates being in an amount between 0.01 wt% and 0.10 wt% inclusive relative to a total weight of the developer.

2. The developer according to claim 1, wherein said toner has the volume average particle size between 3.9 μm and 5.0 μm inclusive.

3. The developer according to claim 1, wherein said agglomerates have a size so that the agglomerates pass through a screen having an opening size of 100 μm and do not pass through a screen having an opening size of 75 μm.

4. The developer according to claim 1, wherein said agglomerates are formed of the additive agent in an agglomerated form.

5. The developer according to claim 1, wherein said toner and said agglomerates are mixed so that a mixture has a degree of agglomeration between 40.3% and 69.1% inclusive.

6. A developer storage unit retaining the developer according to claim 1.

7. A developing device comprising:

developer formed of toner and agglomerates each having respective particle sizes between 75 μm and 100 μm inclusive, said toner including base particles containing at least a binder resin, said base particles each having a surface coated with an additive agent, said toner having a volume average particle size between 3.9 μm and 6.1 μm inclusive, said agglomerates being included in an amount between 0.01 wt % and 0.10 wt % inclusive relative to a total weight of the developer;

a developer supporting member for supporting the developer; and a developer layer forming member for forming a developer layer on the developer supporting member.

8. The developing device according to claim 7, wherein said developer layer forming member is configured to form the developer layer on the developer supporting member in a range between 0.30 mg/cm$^2$ and 0.58 mg/cm$^2$ inclusive.

9. The developing device according to claim 7, wherein said developer layer forming member is configured to form the developer layer on the developer supporting member in a range between 0.30 mg/cm$^2$ and 0.52 mg/cm$^2$ inclusive.

10. An image forming apparatus comprising the developing device according to claim 7.

11. A developer storage unit retaining the developer according to claims 2.

12. The developing device according to claim 7, wherein said toner has the volume average particle size between 3.9 μm and 5.0 μm inclusive

13. An image farming apparatus comprising the developing device according to claim 12.

* * * * *